US012635758B2

(12) United States Patent
Li et al.

(10) Patent No.: US 12,635,758 B2
(45) Date of Patent: May 26, 2026

(54) DEVICE, KIT, AND METHOD FOR STRENGTHENING FOOT MUSCLE

(71) Applicant: TDL SYSTEMS INC., Windsor (CA)

(72) Inventors: Yong Li, LaSalle (CA); Paul Robert Langer, Shoreview, MN (US)

(73) Assignee: TDL Systems Inc., Windsor (CA)

( * ) Notice: Subject to any disclaimer, the term of this patent is extended or adjusted under 35 U.S.C. 154(b) by 66 days.

(21) Appl. No.: 18/894,484

(22) Filed: Sep. 24, 2024

(65) Prior Publication Data

US 2026/0083212 A1 Mar. 26, 2026

(51) Int. Cl.
*A43B 7/1415* (2022.01)

(52) U.S. Cl.
CPC ..... *A43B 7/1415* (2013.01)

(58) Field of Classification Search
CPC ..... A43B 7/1415; A63B 23/10; A63B 23/08; A63B 21/4015; A63B 21/4025; A63B 2209/00; A63B 23/085; A63B 26/003; A63B 1/00; A63B 2023/006; A63B 2071/0655; A63B 21/00047; A63B 21/00058; A63B 21/0442; A63B 21/05; A63B 21/055; A63B 21/0557; A63B 21/068; A63B 21/151; A63B 21/4005; A63B 21/4009; A63B 21/4011; A63B 21/4013; A63B 21/4017; A63B 21/4019; A63B 21/4033; A63B 22/16; A63B 22/18; A63B 2208/0204; A63B 2208/0214;

(Continued)

(56) References Cited

U.S. PATENT DOCUMENTS 4,461,472 A * 7/1984 Martinez ..... A63B 23/10 482/79
5,087,036 A * 2/1992 Cooper ..... A63B 23/085 482/79

(Continued)

FOREIGN PATENT DOCUMENTS

JP 2007-283004 A 11/2007

OTHER PUBLICATIONS

Michaud, Tom, DC, "The ToePro Exercise Platform" and instructions sheets, retrieved Jan. 28, 2024, https://www.humanlocomotion.com/products/toepro-foot-ankle-exercise-platform (13 pages).

(Continued)

*Primary Examiner* — Garrett K Atkinson

(57) ABSTRACT

A device for exercising/strengthening feet includes a left pad for supporting and exercising a left foot and a right pad for supporting and exercising a right foot, each pad comprising a rear portion to support the hindfoot thereon and a front portion to support the midfoot and the forefoot thereon, the front portion comprising a hallux portion to support the hallux. A notch is positioned adjacent to the hallux portion and underneath the first metatarsophalangeal (MTP) joint of the foot. The hallux portion and the notch are configured such that at least a portion of the first MTP joint is unsupported by the front portion to reduce a pressure experienced by the first MTP joint when the hindfoot is supported on the heel portion and to provide increased plantarflexion of the first metatarsal bone of the foot when the hindfoot is raised and unsupported by the rear portion.

20 Claims, 6 Drawing Sheets

(58) Field of Classification Search
CPC ..... A63B 2208/0228; A63B 23/03508; A63B 71/0622
See application file for complete search history.

(56) References Cited

U.S. PATENT DOCUMENTS

| | | | | |
|---|---|---|---|---|
| 5,915,820 | A * | 6/1999 | Kraeuter | A43B 17/02 36/102 |
| 6,862,481 | B1 | 3/2005 | Demian | |
| 6,889,088 | B2 * | 5/2005 | Demian | A61N 1/36021 607/144 |
| 7,383,089 | B2 | 6/2008 | Demian | |
| 8,403,817 | B2 | 3/2013 | Ferguson et al. | |
| 8,707,463 | B2 | 4/2014 | Orloff | |
| 9,364,382 | B1 * | 6/2016 | Cooper | A61H 1/0237 |
| D812,875 | S * | 3/2018 | Petrie | D2/951 |
| 9,913,508 | B2 * | 3/2018 | Tzeng | A43B 1/0081 |
| 10,765,913 | B2 | 9/2020 | Michaud | |
| 11,364,416 | B2 | 6/2022 | Koskela | |
| 2021/0116235 | A1 * | 4/2021 | Gray | A43D 1/027 |
| 2021/0220643 | A1 | 7/2021 | Coleman et al. | |
| 2022/0001177 | A1 | 1/2022 | Coleman et al. | |
| 2022/0339430 | A1 | 10/2022 | Shahriari et al. | |
| 2023/0233844 | A1 | 7/2023 | Paulke et al. | |
| 2023/0277109 | A1 | 9/2023 | Blum et al. | |
| 2023/0347136 | A1 | 11/2023 | Paparella-Wachtel et al. | |
| 2023/0381513 | A1 | 11/2023 | Tellenbach | |
| 2023/0414937 | A1 | 12/2023 | Kim et al. | |
| 2024/0033564 | A1 | 2/2024 | Mapara | |

OTHER PUBLICATIONS

Dr. Ho's, "Pain Therapy System Pro—Essentials Package", retrieved Jul. 15, 2024, https://drhonow.com/products/pain-therapy-system-pro-basic-package (2 pages).
Dr. Ho's, "Circulation Promoting Foot Massage Pads (V4 Wire included)", retrieved Jul. 15, 2024, https://drhonow.com/products/circulation-promoting-foot-massage-pads (3 pages).
Dr. Ho's, "Circulation Promoter Pro (TENS)—Essentials Package", retrieved Sep. 24, 2024, https://drhonow.com/products/circulation-promoter-pro-essential-package (1 page).

* cited by examiner

DEVICE, KIT, AND METHOD FOR STRENGTHENING FOOT MUSCLE

FIELD

The present invention relates generally to muscle strengthening, and more specifically to apparatus, systems, and methods for providing combined heel raise exercise and electrical muscle stimulation to activate and strengthen foot muscles.

BACKGROUND

A human foot has a complex mechanical structure with 26 bones, 33 joints, 19 intrinsic muscles, 10 extrinsic muscles, and many tendons or ligaments. These muscles, joints and bones work together to support the weight of the human body, allowing for postural stability, locomotion, and transmission of force. FIGS. 1A and 1B illustrate the skeletal structure of a right foot 10, including the talus 1, navicular 2, medial cuneiform 4, first metatarsal 6, first metatarsophalangeal (MTP) joint 7, and proximal phalanx 8 and distal phalanx 9 of the hallux (also referred to as the first toe, big toe, or great toe). The first metatarsophalangeal (MTP) joint allows the hallux to dorsiflex or plantarflex during a gait cycle.

As the skeletal systems and muscular systems in a human foot work together to support the weight of the human body, keep postural balance, and produce movement of the body. The foot muscles and their strength are also very important for normal foot functions. The foot muscles can be described as either intrinsic (originating inside the foot) or extrinsic (originating outside the foot). The foot intrinsic muscles are further divided into dorsal and plantar groups and there are 4 layers of plantar muscles. About 40% of total foot muscle volume is dedicated to the hallux which supports the important functional contribution of the first ray and medial longitudinal arch to foot function. Among these foot intrinsic muscles, the abductor hallucis (AbH) is the largest with a typical cross-sectional area of 7 square centimeter and a volume of 15 cubic centimeters. Therefore, it is the main force generating muscle in the foot. The AbH muscle flexes and abducts the first MTP joint and this oblique mechanical action is functionally relevant in stiffening the first MTP joint for postural control, forward progression during the gait cycle and the stability of medial longitudinal arch. In general, foot muscle strength contributes to improved postural balance for older people and to stiffen the forefoot to provide a rigid lever against the ground for push-off. On the other hand, weak foot muscles are a contributing factor for plantar heel pain and hallux valgus. Therefore, foot muscle strengthening is very important for prevention and early-stage treatment of various foot conditions.

Weakness of the foot intrinsic and extrinsic muscles has been associated with aging as well as with the development of various lower extremity conditions, such as hallux valgus, pes planus, plantar fasciitis, Achilles tendinopathy, foot pain or discomfort and reduced mobility. Active contraction of foot intrinsic muscles is related to controlling the medial longitudinal arch when the foot is loaded or balancing as well as to stiffening the foot during push off. Several foot exercises have been recommended for strengthening foot muscles, such as heel raise, short foot and toe spread while the subject stands on a flat floor or exercise mat. For example, a heel raise exercise is performed while standing with slightly bent knees. During the heel raise exercise, the heel of the foot is slowly raised off the floor and the pressure under the foot is concentrated inside the ball of the foot. While keeping the heel at its highest possible position, the body weight is transferred forward onto the toes to keep balance. Next, the heel is slowly lowered back onto the floor. The heel raise exercise may be performed daily, and may be progressively performed while sitting, standing on both feet, or standing on one foot.

As can be understood by those skilled in the art, in order to deliver various foot functions, the foot muscles recruit or activate motor units and its muscle fibers to generate contractile forces. Activating more motor units of a foot muscle can generate a stronger muscle contractile force. Motor unit recruitment is a measure of how many motor neurons are activated in a particular muscle, and therefore is a measure of how many muscle fibers of that muscle are activated. A strong muscle can have higher motor unit recruitment for that muscle. Motor units are generally recruited in the order of the smallest units to the largest units (or, from low-threshold motor neurons to high-threshold motor neurons). Most of known foot exercises are voluntary aerobic exercises which recruit the low-threshold motor units.

However, these exercises can be challenging for some people to perform since a number of foot muscles are very difficult to activate during such foot exercises even for healthy people. For example, it's very difficult to train the AbH muscle to perform first MTP joint dorsiflexion and abduction at the same time. Some of these foot exercises are also not very effective for some individuals.

It is thus desirable to provide devices and improved methods for assisting and improving the effects of foot exercises and can be used to passively activate or strengthen intrinsic foot muscles.

SUMMARY

In various aspects of the present disclosure, devices and methods for foot muscle exercise and strengthening, such as performing a heel raise exercise, are provided. In particular, a pair of foot pads are provided for supporting the feet when performing the heel raise exercise. Further, a muscle stimulation device may be used to stimulate foot muscles during the heel raise exercise to activate the foot muscles.

Thus, in a first aspect, there is provided a device for exercising and strengthening human feet, comprising a pair of pads comprising a left pad for supporting and exercising a left foot and a right pad for supporting and exercising a right foot, each one of the pads comprising a rear portion configured to support a hindfoot of a human foot thereon, and a front portion configured to support the midfoot and the forefoot of the human foot thereon, the front portion comprising a hallux portion configured to support the hallux of the human foot, and a notch positioned adjacent to the hallux portion and to be underneath the first metatarsophalangeal (MTP) joint of the human foot, wherein the hallux portion and the notch are configured such that at least a portion of the first MTP joint is unsupported by the front portion to reduce a pressure experienced by the first MTP joint when the hindfoot is supported on the heel portion and to provide increased plantarflexion of the first metatarsal bone of the human foot when the hindfoot is raised and unsupported by the rear portion.

In this device, the hallux portion may have a top side sloped upward towards an anterior distal end of the hallux portion for increasing the plantarflexion of the first metatarsal bone. The top side of the hallux portion may be sloped at a slope angle of at least 3 degrees. The device may further comprise a muscle stimulation apparatus for stimulating foot muscles when the foot muscles are exercised using the pads. The muscle stimulation apparatus may comprise an electrical muscle stimulation (EMS) apparatus. The EMS apparatus may comprise a controller for generating controlled electrical impulses to be applied to the feet and a pair of foot wraps comprising electrical connectors and contact electrodes, the electrical connectors being configured for connection with the controller, and the contact electrodes being configured for applying the electrical impulses to portions of the feet in contact with the contact electrodes. The contact electrodes may be positioned to stimulate a portion of the AbH muscle or flexor hallucis brevis muscle of the human foot. The EMS apparatus may comprise a pair of power and signal cables for connecting the controller to the electrical connectors of the foot wraps. Each foot wrap may comprise a central section and a plurality of terminal sections. The central section may comprise a pair of electrical connectors on an outer side of the foot wrap and a pair of contact electrodes on an inner side of the foot wrap opposite to the electrical connectors. A first terminal section may comprise a first strap for wrapping around the hallux of the foot. A second terminal section may comprise a second strap for wrapping around the heel of the foot. A third terminal section may comprise one or more straps for securing the central section around an arch section of the foot. The foot wraps may comprise a stretchable fabric material. The pads may comprise a resilient material having a Shore hardness between 25A to 50D. Each pad may comprise a top side having a contoured surface.

In another aspect, there is provided a kit comprising a pair of pads as described herein; a pair of wraps as described herein for connection with a generator for generating electric muscle stimulation (EMS) impulses, wherein the outer side of the wrap comprises electrical connectors and the inner side of the wrap comprises contact electrodes in electrical communication with the electrical connectors and configured and positioned for applying the EMS impulses to portions of the foot in contact with the contact electrodes; and a pair of cables for connecting the electrical connectors of the foot wraps to the generator. In the kit, the contact electrodes may be positioned to stimulate a portion of the AbH muscle or the flexor hallucis brevis muscle of the foot. The kit may further comprise the generator. The kit may further comprise a medium having instructions thereon for directing a user to perform foot exercises and stimulation using the kit. The instructions may direct the user to wear the foot wraps on the feet of the user; connect the generator to the foot wraps; place the wrapped feet on respective ones of the pads, with the MTP joints positioned in the respective notches; apply EMS impulses generated by the generator to the feet; and repeatedly raise and lower heels of the feet while the balls and toes of the feet are supported on the pads. The instructions may also direct the user to apply the EMS pulses to the feet while seated and not performing exercises in order to stimulate the AbH muscle or flexor hallucis brevis muscle passively prior to starting heel raise exercises.

In a further aspect, there is provided a method of exercising and stimulating human feet using a device described herein. The method comprises wearing the foot wraps on the feet; connecting the EMS controller to the foot wraps; placing the wrapped feet on respective ones of the pads, with the MTP joints positioned in the notches of the respective pads; repeatedly raising and lowering heels of the feet while the balls and toes of the feet are supported on the pads; and applying EMS impulses generated by the controller to the feet while the feet are raised or lowered.

Other aspects, features, and embodiments of the present disclosure will become apparent to those of ordinary skill in the art upon review of the following description of specific embodiments in conjunction with the accompanying figures.

BRIEF DESCRIPTION OF THE DRAWINGS

In the figures, which illustrate, by way of example only, embodiments of the present disclosure.

DETAILED DESCRIPTION

In brief overview, an embodiment of the present disclosure relates to exercise pads for strengthening feet, where the exercise pad has a notch below the joint between the first metatarsal and the proximal phalanx of the hallux of the foot. Another embodiment of the present disclosure relates to a kit including the exercise pads and a foot massager. In a further embodiment, the exercise pads and foot massager are used simultaneously during foot exercise.

Conveniently, the simultaneous exercise and stimulation of the foot provide improved effects for strengthening the foot muscles. In addition, the stimulation of the foot muscles without foot exercises also has benefits in strengthening foot muscles.

Figure 1A:
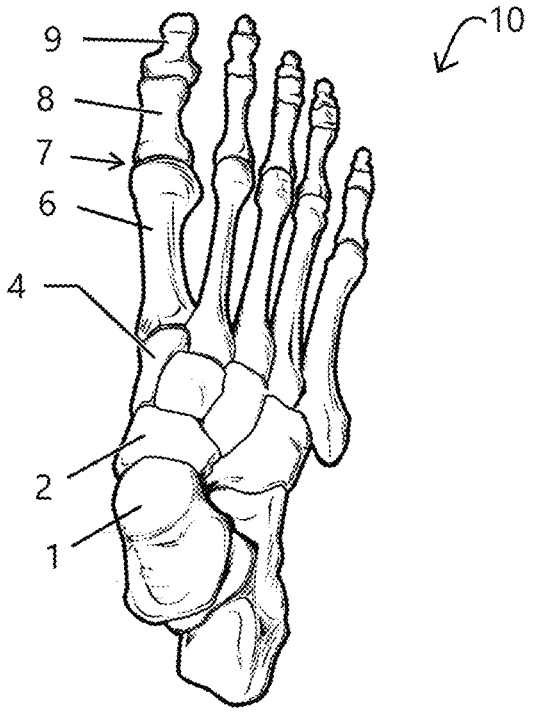
FIG. 1A (PRIOR ART)
FIG. 1A is a top anatomical view of the skeletal structure of a human right foot.
Figure 1B:
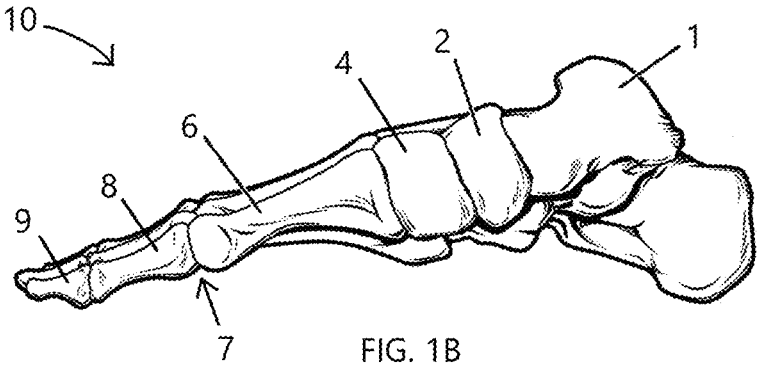
FIG. 1B (PRIOR ART)
FIG. 1B is a medial anatomical view of the skeletal structure of FIG. 1A.
Figure 2A:
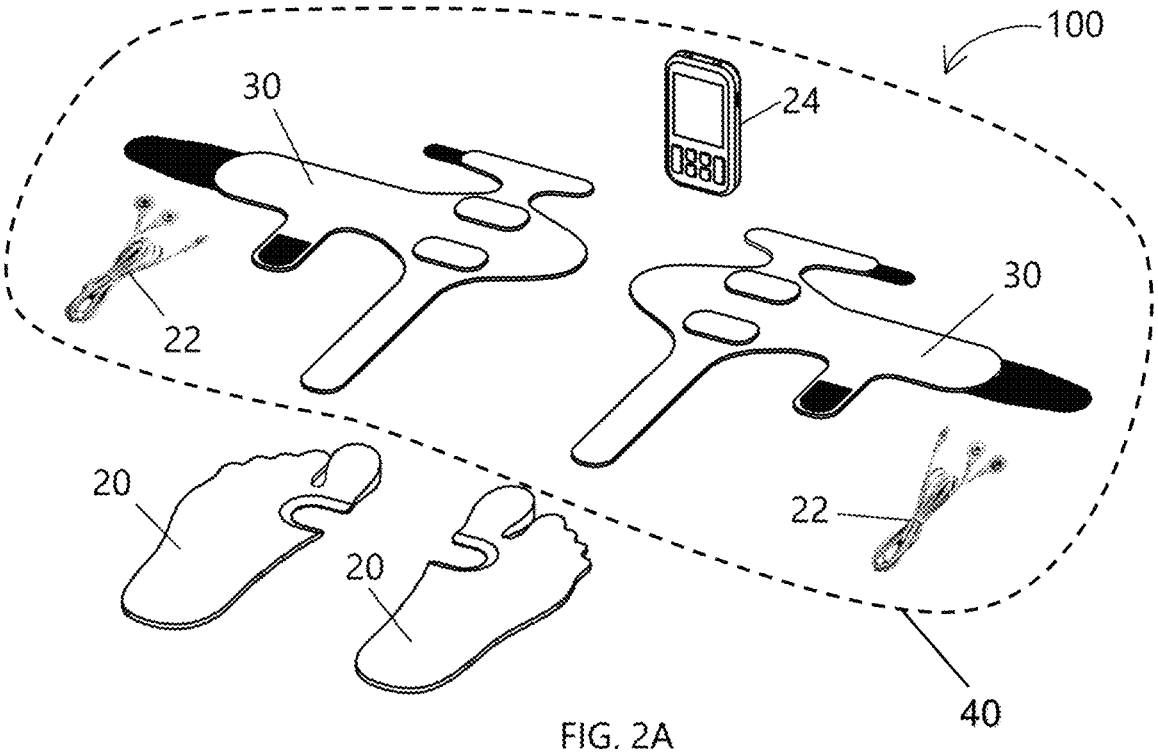
FIG. 2A is a perspective view of a kit for foot exercising and strengthening, according to an embodiment of the present disclosure.
Figure 2B:
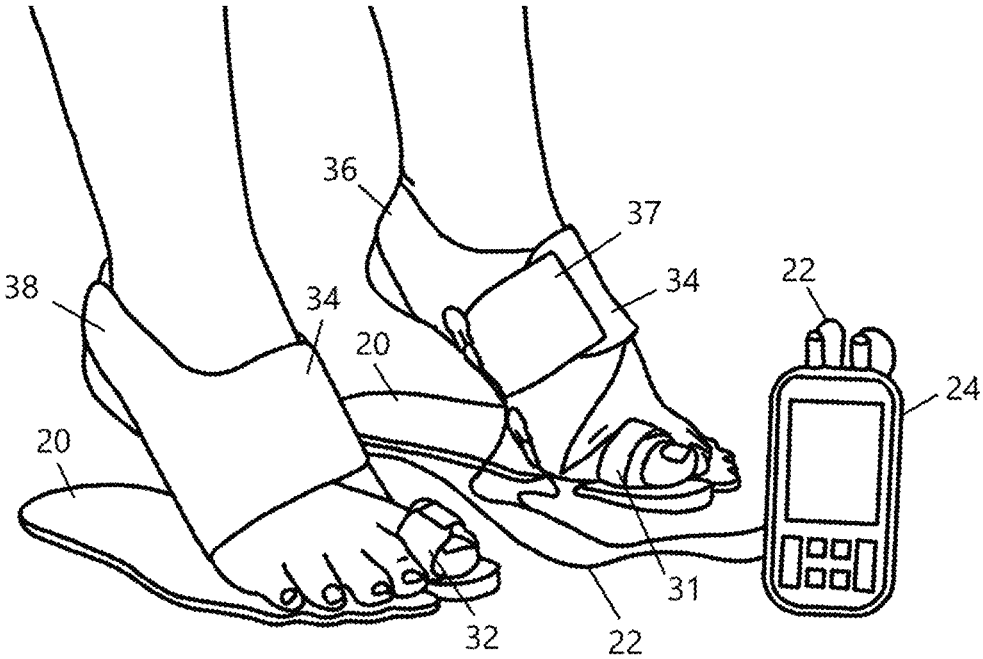
FIG. 2B is a perspective view of the kit of FIG. 2A in use.

FIG. 2A illustrates a device 100 for foot exercising and strengthening, which includes a pair of foot exercise pads 20 and an electronic muscle stimulation (EMS) apparatus 40 that includes a controller 24 and a pair of foot wraps 30 connected to the controller 24 by respective power and signal cables 22. Device 100 may be provided as a kit or in a package. FIG. 2B illustrates the device 100 in use.

The EMS controller 24 may be any suitable EMS power and control unit for stimulating muscles, particularly foot muscles. For example, any commercially available EMS units may be used.

Pads 20 are configured and suitable for heel raise exercises. The pair of pads 20 includes a pad for the left foot and a pad for the right foot. To further illustrate, the right foot pad 20 is shown in isolation in FIGS. 3-5. It should be understood that the left foot pad has corresponding shapes and features, but symmetrically mirrored for the left foot. The descriptions below regarding pad 20 applies to both the right foot and left foot pads with symmetrical adjustments or modifications.

As will be described further below, the pair of foot pads 20 can be used to facilitate sagittal plane motion of the first metatarsophalangeal (MTP) joint to allow heel raise exercise to be more effective for foot muscle strengthening.

Figure 3:
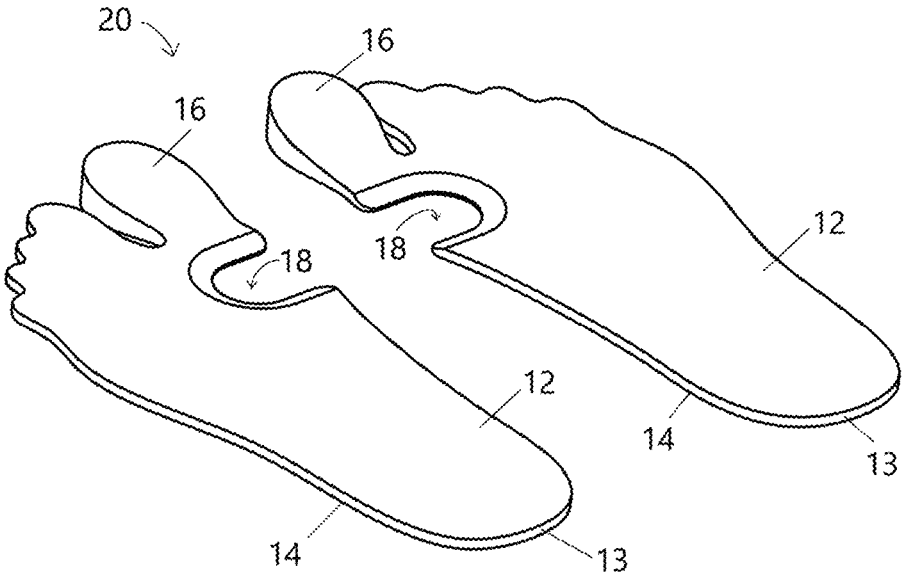
FIG. 3 is a top, anterior perspective view of the pair of foot exercise pads in the device of FIG. 2A.
Figure 4:
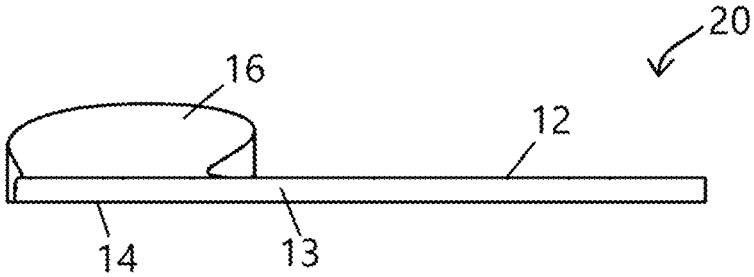
FIG. 4 is an anterior elevation view of the right foot exercise pad of FIG. 3.
Figure 5:
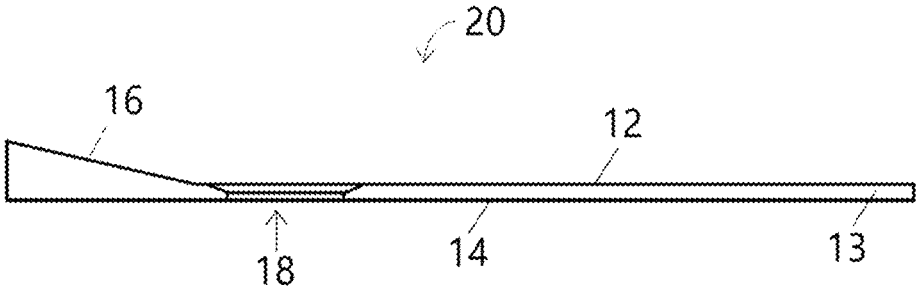
FIG. 5 is a medial elevation view of the right foot exercise pad of FIG. 3.

In selected embodiments, as illustrated in FIGS. 3 to 5, the foot pad 20 is shaped to conform to the general shape of the corresponding human foot (left or right).

Each pad 20 has a foot-supporting top side 12, a bottom side 14 opposite to the top side 12, and an edge 13 between sides 12, 14. The bottom side 14 may be flat or have a surface shaped to provide a stable support base. The top side 12 has a contoured surface shaped to conform to the general shape of the bottom of the foot. Pads 20 are generally configured to support the feet of a person during heel raise exercises. The edge 13 of the pad 20 has a profile generally matching the outline profile of the foot.

As can be understood, the bottom side 14 of the foot pad 20 is intended to be in contact with the ground or the surface on which the user will perform the foot exercise.

The sizes of the pads may be selected to fit the feet of the target users. However, the same pads may be used by different users with different sizes of feet, as long as the feet are within the normal range of adult feet. For example, for use by a typical adult person, the pad 20 may have a length (from toe to heel) of from 20 cm to 35 cm, and a width (maximum distance from the medial edge to the lateral edge) of from 7 cm to 15 cm. The thickness of foot pad 20 may be from 0.2 cm to 3 cm.

The pad 20 may be formed of any suitable material, such as a plastic material. In some embodiments, the pad 20 may include a resilient material with a Shore Hardness between 25A to 50D.

As better seen in FIG. 3, pad 20 has a notch 18 at the location that would be under the first metatarsophalangeal (MTP) joint of the foot (i.e., the joint next to the hallux) when the foot is properly placed on the pad (see FIG. 6), to facilitate the plantarflexion of the first metatarsal bone to achieve a plantarflexed position in relation to the other metatarsal bones. The notch 18 also reduces the upward force applied to the first MTP joint. Notch 18 may have a generally U-shaped profile as depicted in FIG. 3. In other embodiments, notch 18 may have a generally C-shaped profile or other suitable shapes. Notch 18 may have a beveled edge as better illustrated in FIGS. 3 and 5. Notch 18 may have a width and a depth selected to accommodate the first MTP joint of a typical adult person. For example, the width of notch 18 may be in the range of 10 to 40 millimeters, and the depth of notch 18 may be in the range of 20 to 50 millimeters. The sloped surface of the beveled edge of notch 18 may have a sloping angle of about 3 to 45 degrees relative to the top surface of the flat heel portion of the pad 20. The width of the beveled edge may be from 2 to 15 millimeters.

As can be seen in FIGS. 3-6, pad 20 has a flat heel portion and a ball and toe portion with a contoured top surface. The ball and toe portion of pad 20 includes a raised hallux portion 16 having a sloped top surface, which slopes upwards in the anterior direction, or along the medial longitudinal arch direction towards the distal phalanx when the foot is properly placed on the pad 20. The sloped hallux portion 16 is placed under the hallux during exercise to increase dorsiflexion of the hallux. The slope of the raised hallux portion 16 may have a slope angle of about 3 to 45 degrees, to further reduce the upward pressure applied by the pad to the first MTP joint.

Figure 6:
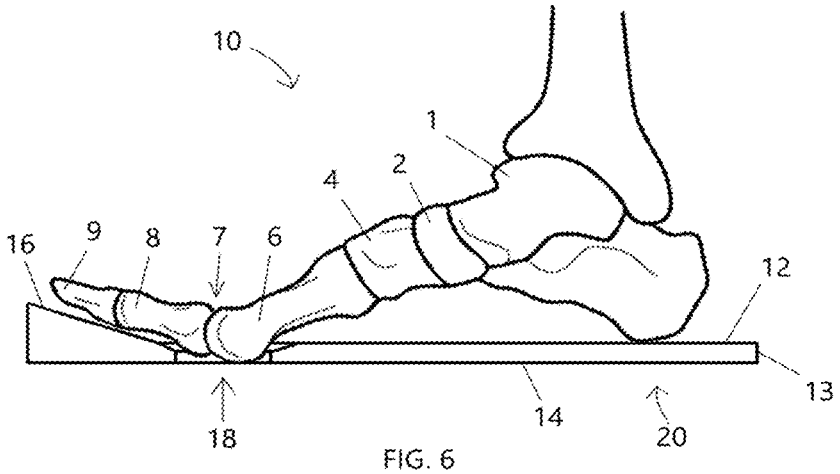
FIG. 6 is a medial elevation view of a skeletal structure of a human right foot resting on the right foot exercise pad of FIG. 3.

During use, the human foot 10 to be exercised is placed on the pad 20, as illustrated in FIG. 6, with the heel of the foot 10 supported on the heel portion of the pad 20, the hallux with bones 8 and 9 supported on the raised hallux portion 16, and the first MTP joint 7 (joined ends of bones 6 and 8) placed in the notch 18. During the foot exercise, the heel is repeatedly raised, away from the pad 20, and lowered, towards and may contact, the heel portion of the pad 20.

As shown in FIG. 6, when the foot 10 is placed on the pad 20, the notch 18 allows the first metatarsal bone 6 and the first MTP joint 7 to plantarflex, and the raised hallux portion 16 forces the proximal phalanx 8 and distal phalanx 9 of hallux to dorsiflex. The raised hallux portion 16 and the notch 18 together can reduce the reaction force (upwards pressure) from the pad under and experienced by the first metatarsal 6 and unlock the first MTP joint.

The beneficial effects of using the pad 20 include promoting stability of the foot by optimizing mechanical advantage of the peroneus longus, abductor hallucis and flexor hallucis brevis muscles and leading to strengthening of the foot muscles more effectively when carrying out the heel raise exercise.

With the pads 20 and the simultaneous muscle stimulation as described herein, the user can conveniently train the AbH muscle to perform first MTP joint plantarflexion and abduction at the same time while facilitating optimal alignment of the first metatarsophalangeal joint. As can be understood by those skilled in the art, the synchronous recruitment of muscle motor units achieved during the simultaneous exercise and stimulation allows full activation to their full capacity.

Stimulating the foot muscle during the heel raise exercise can overcome voluntary foot muscle activation deficit and enhance foot functions for healthy people as well as offsetting muscle weakness in a pathological foot.

In an embodiment, electrical impulses may be delivered to the nerves located in the medial side of the foot, which cause the foot muscles to contract mimicking the muscle action directed by the central nervous system of a person.

For example, the EMS apparatus 40 may be used for this purpose.

Figure 7:
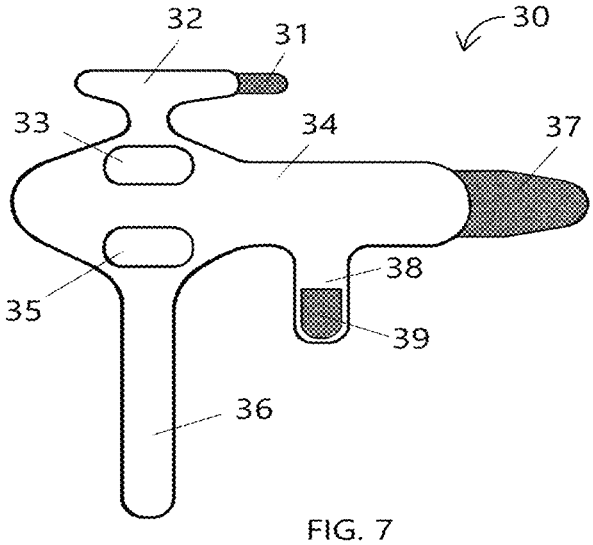
FIG. 7 is a top view of the foot wrap for the right foot in the device of FIG. 2A.
Figure 8:
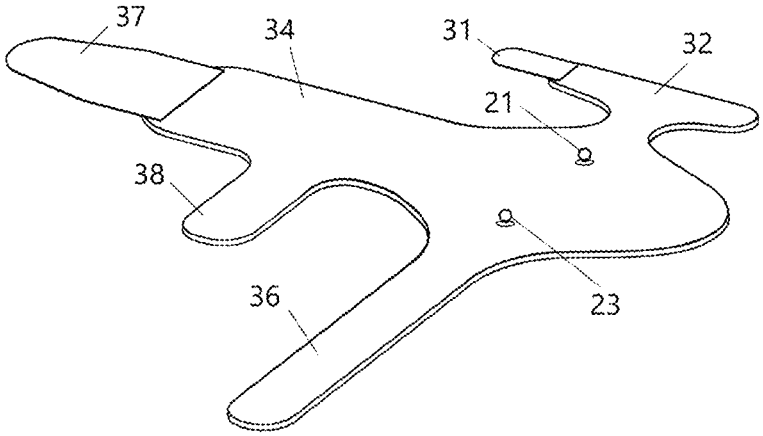
FIG. 8 is a bottom perspective view of the foot wrap of FIG. 7.

Each foot wrap 30 is sized and shaped to be worn on a corresponding human foot. For illustration purposes, the wrap 30 for the right foot is depicted in FIGS. 7 and 8. While FIGS. 7-8, and FIGS. 9-12 depict the foot wrap 30 for the right foot only, it should be understood that the following descriptions regarding the foot wrap 30 apply to the foot wraps 30 for both feet, with some modification or adjustment for the corresponding right or left foot.

Each wrap 30 may include one or multiple layers of stretchable fabric and have two contact electrodes 33 and 35 mounted on a central section 34 of wrap 30 for applying electric stimulation to the corresponding parts of the foot in contact with the contact electrodes 30 and 35, as will be further described below.

In some embodiments, the foot wrap 30 comprises multiple straps 32, 36, 38 extending away from central section 34 for securing the foot wrap and its contact electrodes in position relative to the foot.

FIG. 7 shows the inner side of the foot wrap 30, which contacts the foot skin during use, and FIG. 8 shows the outer side of the foot wrap 30, which faces outward during use. Thus, when the foot wrap 30 is worn by the user with the inner side facing the foot skin, the contact electrodes 33 and 35 are in contact with the foot skin adjacent to the AbH muscle, and the connection buds 21, 23 on the outer side of the wrap 30 are exposed for connecting with the controller 24 through cable 22 with electrical connectors 25,26.

Strap 32 extends from a front end of the central section 34 and is configured to be wrapped around the hallux of the foot and may be comfortably fastened around the hallux using a fastener 31 thereon. In some embodiments, the use of strap 32 is optional and a foot wrap 30 can be without the strap 32.

Straps 36 and 38 extend from a rear end of central section 34 and are configured to be wrapped around the heel of the foot and may be comfortably fastened to each other using a fastener 39, which may be located on the strap 38.

The central section 34 with a terminal section 37 is configured to be wrapped around the arch section of the foot and may be comfortably fastened with a fastener on the terminal section 37.

The fasteners, such as fasteners 31, 37, 39, on the foot wrap 30 may each be a hook-and-loop fastener, commonly referred to as a VELCRO™ strip. Other suitable quick-connect-and-disconnect fasteners may also be used.

Figure 9:
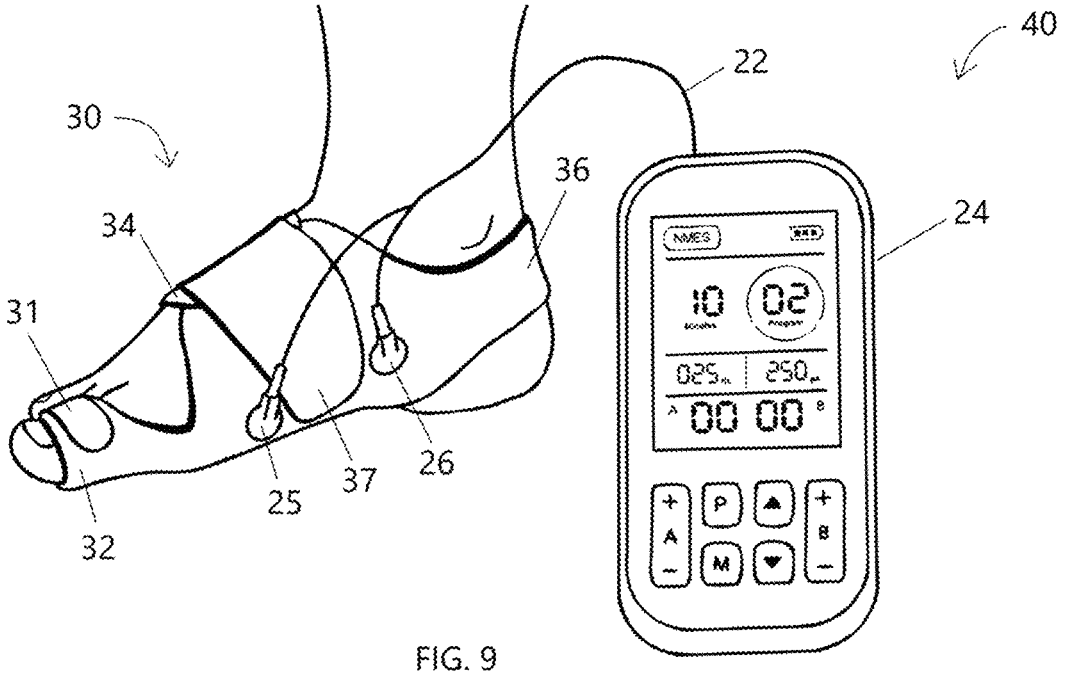
FIG. 9 is a top, anterior, medial perspective view of a right foot wearing the foot wrap of FIG. 7 connected to the controller of FIG. 2A.

During use, as illustrated in FIGS. 2 and 9, the user wears each foot wrap 30 on the corresponding foot, and the electrical connectors 25, 26 of wrap 30 are connected to the controller 24 through cable 22.

In some embodiments, the stretchable fabric and multiple extended straps or arms of the foot wrap 30 will produce sufficient compression force against the contact electrodes 33, 35 to ensure robust and continuous electrical contact between the contact electrodes 33, 35 and skin of the human foot when the foot wrap 30 is worn on the foot. In addition, the foot wrap 30 can conveniently and reliably place electrodes 33, 35 precisely at the desired locations on the medial and plantar side of the foot, in order to deliver electrical muscle stimulation to the target foot muscles located at the medial and plantar side of the foot underneath the skin. In some embodiments, the foot wrap 30 may have a thickness from 2 to 12 mm.

In some embodiments, as depicted in FIG. 7, the contact electrodes 33, 35 on the inner surface of the foot wrap 30 are located such that one of electrodes, such as electrode 33, is closer to the first MTP joint and the other electrode, such as electrode 35, is closer to the heel when the foot wrap 30 is worn on the foot.

As depicted in FIG. 8, the outer surface of foot wrap 30 has mounted thereon two electrical connectors 21, 23 that are in electrical communication with the contact electrodes 33, 35 respectively. Connectors 21, 23 may be snap button connectors.

The controller 24 of the EMS apparatus 40 may be constructed and configured to generate electrical impulses according to preset therapeutic electrical specifications and to deliver the electrical impulses to the contact electrodes 33, 35 via cable 22 and connectors 21, 23.

In some embodiments, the controller 24 may include a computing device or mobile device, such as a mobile phone or a tablet, which may communicate or connect with the electrodes located on the foot wrap 30 via wired or wireless connections, such as Bluetooth, WIFI, or other suitable wireless communication techniques.

In some embodiments, the controller 24 can store multiple preset treatment programs and allow a user to select a specific treatment program to activate or re-educate the foot muscles for the purpose of muscle strengthening.

In some embodiments, the electrical impulses generated by the controller 24 can be either voltage or current driven and driving electrical signal may have a symmetric or asymmetric biphasic waveform. In some embodiments, the frequency of the electrical impulses may be from 20 Hz to 100 Hz and the impulse duration may be from 100 microsecond (μs) to 600 microsecond (μs). In some embodiments, the amplitude of the electrical wave may be from 1 mA to 80 mA and can be directly controlled by adjusting the settings on controller 24. In some embodiments, a single EMS treatment cycle may include a period of stimulation for 3 to 15 seconds and a period of resting (no stimulation) for 3 to 15 seconds. In some embodiments, the treatment cycle may be repeated over a number of times. For example, an EMS treatment session may last 5 to 30 minutes. The treatment session may be coordinated with the foot raise exercises or may be used passively.

In different embodiments, controller 24 and the contact electrodes 33 and 35 may be connected by wire or wirelessly, such as using a BLUETOOTH™ connection or other suitable wireless connection techniques. In some embodiments, controller 24 may provide two independent communication channels for connection with the pair of foot wraps 30 and generate respective electrical impulses for each one of the pair of foot wraps 30.

During use, as depicted in FIGS. 2 and 9, the foot wraps 30 are worn on respective feet of the user and connected with the controller 24 by cables 22. One end of each cable 22 may have a male connector for plug into a female socket provided on controller 24 and another end of the cable 22 may include a pair of snap-button type of connectors 25 and 26, which can detachably couple with the electrical connectors 21, 23 respectively on the foot wrap 30.

Figure 10:
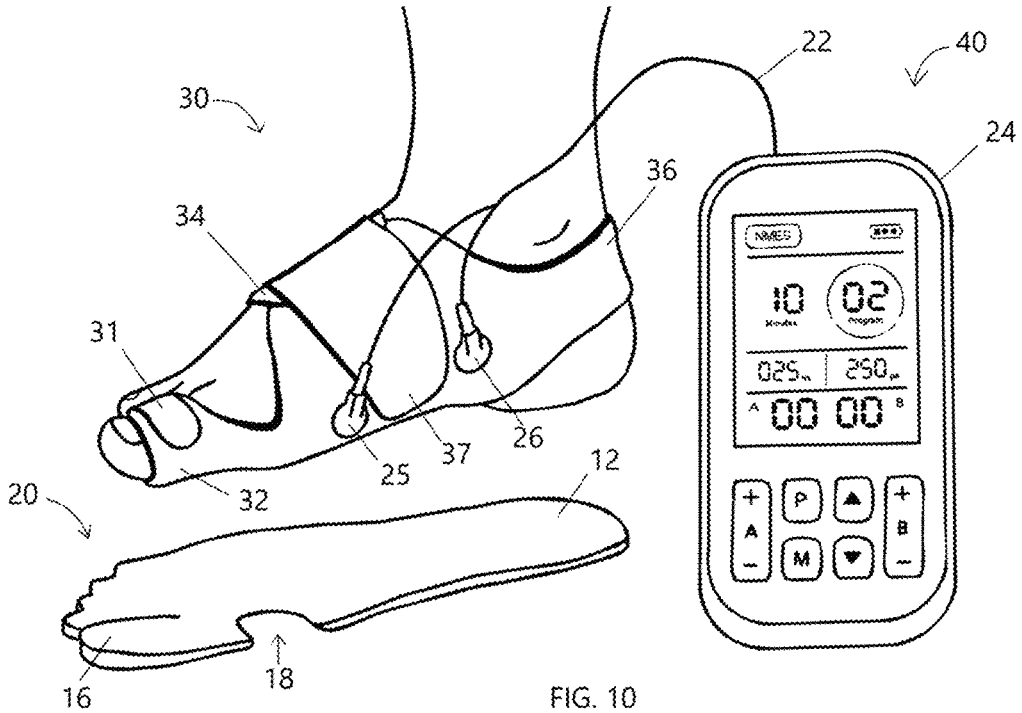
FIGS. 10, 11 and 12 are top, anterior, medial perspective views of the right foot of FIG. 9 in different positions relative to the exercise pad for the right foot during use.
Figure 11:
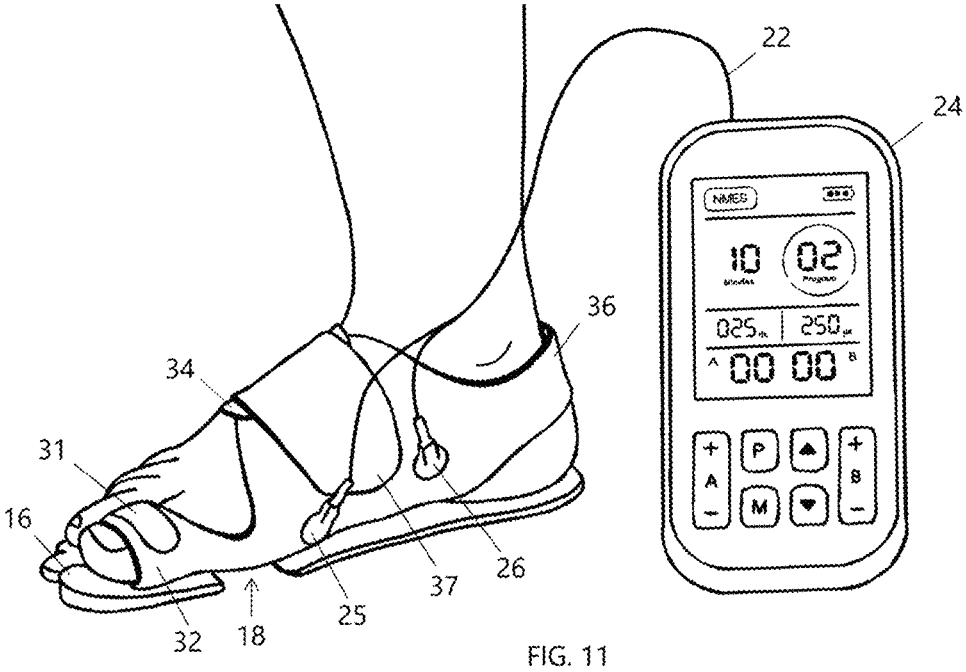

As depicted in FIGS. 10 and 11, the foot wearing foot wrap 30 connected to controller 24 is placed on top of the foot exercise pad 20 and supported by pad 20. As can be seen from FIG. 11, the foot initially rests on pad 20 with both the forefoot and rearfoot resting and supported on pad 20. The user can then select an EMS program using controller 24. For example, the user may use the controller 24 to gradually increase the EMS signal intensity, while still feels comfortable. Each stimulation cycle may include a stimulation phase and a resting phase, and the user may feel muscle contraction during the stimulation phase and muscle relaxation during the resting phase. These two phases may alternate in repeating cycles. For example, the stimulation phase may last for 5 seconds, and the resting phase may immediately follow and last for 5 seconds.

Figure 12:
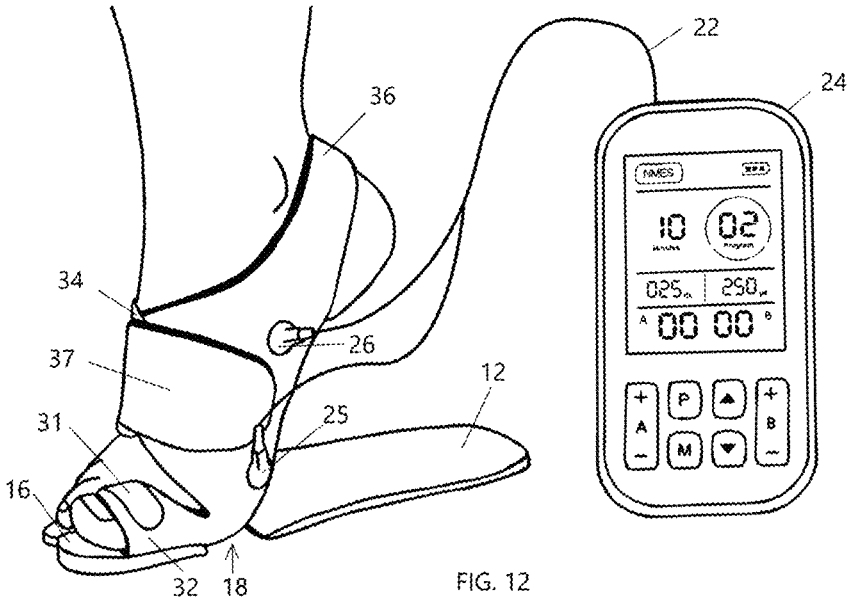

In an embodiment, on or after commencement of the stimulation phase, the user raises the heels and holds them at their highest possible positions for the particular user, as illustrated in FIGS. 2 and 12; and on or after termination of the stimulation phase, the user lowers the heels back to rest them on the heel portion of foot exercise pad 20, as illustrated in FIG. 11. Alternatively, the user my repeatedly raise and lower the heels during the stimulation phase, and rest the muscles by keeping the heels on the pads 20 during the resting phase.

An embodiment disclosed herein relates to a method for foot muscle strengthening by combining electrical muscle stimulation with a foot heel raise exercise, utilizing both foot exercise pad 20 and device 40 as described herein. Without being limited to any particular theory, it is expected that this method of heel raise exercises can increase oxygen consumption, blood lactate concentration, and a respiratory gas exchange ratio in the user, as compared to a conventional heel raise exercise without electrical muscle stimulation and without use of the pad 20. Consequently, this method of foot exercise is expected to be more effective for strengthening foot muscles, particularly the AbH muscle.

As alluded to earlier, foot exercises involving voluntary aerobic exercises will tend to recruit only the low-threshold motor units, without activating the high-threshold motor units. By comparison, when the foot is subjected to electrical muscle stimulation, the motor unit recruitment pattern in the stimulated muscle is expected to preferentially favor recruitment of high-threshold motor units or random recruitment of both low-threshold and high-threshold motor units. Thus, when the foot is both exercised using pads 20 and subjected to electrical muscle stimulation using device 40 at the same time, the combined effects of voluntary aerobic heel raise exercise and electrical muscle stimulation can activate significantly more motor units in foot muscles, as compared to foot exercise only or electrical stimulation only. The combined muscle exercise and stimulation can thus provide improved muscle strengthening effects.

Strengthening foot muscles by foot exercises using a device as disclosed herein may help to increase toe and arch strength and prevent accidental fall and related injury.

As now can be appreciated, the specific embodiments described above may be modified or varied to provide similar effects or provide improved effects or performance.

For example, it is possible to modify or treat the under surface of pad 20 or the top surface of pad 20 to improve friction to prevent slippage of the foot on the pad 20, or the pad 20 on the ground or floor surface.

In some embodiments, massaging knobs or buttons or similar surface protrusion structures (not shown) may be provided on the top surface of pad 20, which may be used to stretch tense plantar muscles or stimulate proprioception or other neurological effects. The massaging knobs or buttons may be similar to the massaging knobs provided on conventional slippers or sandals with massaging knobs or buttons. The knobs or buttons may have a number of different shapes, including dome, cone, pyramid and may incorporate different patterns/shapes in different regions of the top surface. The sizes and shapes of the massaging protrusions may be selected, and the protrusions may be positioned to provide reflexological effects or for reflexology treatment.

In some embodiments, a slip-prevention structure may be provided on the underside of pad 20.

Pad 20 may be made of a more rigid or softer material depending on the preference of the user or the purpose for which it is used.

In some embodiments, the density, thickness and size of the pad 20 may be selected to increase or decrease stability. For example, on the one hand, a thinner and larger pad may be more stable, and may be suitable for users of weak leg strength such as elders. On the other hand, a thicker pad 20 may allow more plantarflexion of the first metatarsal bone when the heel is raised. Also a softer pad may increase instability thereby challenging balance and promoting proprioceptive benefits.

In some embodiments, pads 20 may be configured and used to relieve heel spurs or treat plantar fasciitis related foot pain, other foot aches and pains, foot neuropathy, or diabetic feet.

In some embodiments, pad 20 may be provided with a soft underlayer, which may extend over the notch 18, to provide a more comfortable feel.

In some embodiments, EMS apparatus 40 may be optionally configured to provide transcutaneous electrical nerve stimulation (TENS) and may include a conventional TENS machine or TENS unit.

The foot wraps and the contact electrodes thereon may be configured to overlay the foot muscles to be stimulated during foot exercises. For example, they may be positioned for contacting the skin of the foot superficial to the specific foot muscle, such as a particular portion of the AbH muscle, where the specific foot muscle may lie partially or wholly underneath the skin portion that is in contact with the contact electrodes.

The anatomical terms are used in their common and well accepted meanings in the art herein. For example, the longitudinal axis of a foot extends from the heel towards the toes, and terms such as "medial", "lateral", "dorsal", "plantar", "superficial", "proximal", and "distal" have their respective art-recognized meanings.

Numerical values specified herein, unless expressly indicated otherwise, are stated as approximations as though the minimum and maximum values within a stated range are both preceded by the word "about." It is understood that slight variations above and below a stated range may not materially affect the use or performance of the specific embodiment and can still be used to achieve substantially the same results as values within the specified range.

It will be understood that any range of values herein is intended to specifically include any intermediate value or sub-range within the given range, and all such intermediate values and sub-ranges are individually and specifically disclosed.

It will also be understood that the word "a" or "an" is intended to mean "one or more" or "at least one," and any singular form is intended to include plurals herein, unless otherwise specified in a particular context.

It will be further understood that the term "comprise," including any variation thereof, is intended to be open-ended and means "include, but not limited to," unless otherwise specifically indicated to the contrary.

When a list of items is given herein with an "or" before the last item, any one of the listed items or any suitable combination of two or more of the listed items may be selected and used.

Of course, the above described embodiments of the present disclosure are intended to be illustrative only and in no way limiting. The described embodiments are susceptible to many modifications of form, arrangement of parts, details, and order of operation. The invention, rather, is intended to encompass all such modification within its scope, as defined by the claims.

What is claimed is:

1. A device for exercising and strengthening human feet, comprising:

a pair of pads comprising a left pad for supporting and exercising a left foot and a right pad for supporting and exercising a right foot, each one of the pads comprising a rear portion configured to support a hindfoot of a human foot thereon, and a front portion configured to support the midfoot and the forefoot of the human foot thereon, the front portion comprising a hallux portion configured to support the hallux of the human foot, and a notch positioned adjacent to the hallux portion and to be underneath the first metatarsophalangeal (MTP) joint of the human foot, wherein the hallux portion and the notch are configured such that at least a portion of the first MTP joint is unsupported by the front portion to reduce a pressure experienced by the first MTP joint when the hindfoot is supported on the heel portion and to provide increased plantarflexion of the first metatarsal bone of the human foot when the hindfoot is raised and unsupported by the rear portion.

2. The device of claim 1, wherein the hallux portion has a top side sloped upward towards an anterior distal end of the hallux portion for increasing dorsiflexion of the hallux.

3. The device of claim 2, wherein the top side of the hallux portion is sloped at a slope angle of at least 3 degrees.

4. The device of claim 1, further comprising a muscle stimulation apparatus for stimulating foot muscles when the foot muscles are exercised using the pads.

5. The device of claim 4, wherein the muscle stimulation apparatus comprises an electrical muscle stimulation (EMS) apparatus.

6. The device of claim 5, wherein the EMS apparatus comprises a controller for generating controlled electrical impulses to be applied to the feet and a pair of foot wraps comprising electrical connectors and contact electrodes, the electrical connectors being configured for connection with the controller, and the contact electrodes being configured for applying the electrical impulses to portions of the feet in contact with the contact electrodes.

7. The device of claim 6, wherein the contact electrodes are positioned to stimulate a portion of the abductor hallucis muscle or the flexor hallucis brevis muscle of the human foot.

8. The device of claim 6, wherein the EMS apparatus comprises a pair of power and signal cables for connecting the controller to the electrical connectors of the foot wraps.

9. The device of claim 6, wherein each one of the foot wraps comprises a central section and a plurality of terminal sections, the central section comprising a pair of the electrical connectors on an outer side of the foot wrap and a pair of the contact electrodes on an inner side of the foot wrap opposite to the electrical connectors, a first one of the terminal sections comprising a first strap for wrapping around the heel of the foot, and a second one of the terminal sections comprising one or more second straps for securing the central section around an arch section of the foot.

10. The device of claim 9, wherein a third one of the terminal sections comprising a third strap for wrapping the hallux of the foot.

11. The device of claim 9, wherein the foot wraps comprise a stretchable fabric material.

12. The device of claim 1, wherein the pads comprise a resilient material having a Shore hardness between 25A to 50D.

13. The device of claim 1, wherein each one of the pads comprises a top side having a contoured surface.

14. A kit comprising:

a pair of pads comprising a left pad for supporting and exercising a left foot and a right pad for supporting and exercising a right foot, each one of the pads comprising a rear portion configured to support a hindfoot of a human foot thereon, and a front portion configured to support the midfoot and the forefoot of the human foot thereon, the front portion comprising a hallux portion configured to support the hallux of the human foot, and a notch positioned adjacent to the hallux portion and to be underneath the first metatarsophalangeal (MTP) joint of the human foot, wherein the hallux portion and the notch are configured such that at least a portion of the first MTP joint is unsupported by the front portion to reduce a pressure experienced by the first MTP joint when the hindfoot is supported on the heel portion and to provide increased plantarflexion of the first metatarsal bone of the human foot when the hindfoot is raised and unsupported by the rear portion;

a pair of wraps comprising a left wrap for the left foot and a right wrap for the right foot, each one of the wraps comprising an outer side and an inner side, the outer side comprising electrical connectors for connection with a generator for generating electric muscle stimulation (EMS) impulses, the inner side comprising contact electrodes in electrical communication with the electrical connectors and configured and positioned for applying the EMS impulses generated by the generator to portions of the foot in contact with the contact electrodes; and a pair of cables for connecting the electrical connectors of the foot wraps to the generator.

15. The kit of claim 14, wherein the contact electrodes are positioned to stimulate a portion of the AbH muscle of the foot.

16. The kit of claim 14, wherein the hallux portion has a top side sloped upward towards an anterior distal end of the hallux portion.

17. The kit of claim 14, further comprising the generator.

18. The kit of claim 14, further comprising a medium having instructions thereon for directing a user to perform foot exercises and stimulation using the kit.

19. The kit of claim 18, wherein the instructions direct the user to wear the foot wraps on the feet of the user;

connect the generator to the foot wraps;

place the wrapped feet on respective ones of the pads, with the MTP joints positioned in the respective notches;

apply EMS impulses generated by the generator to the feet; and repeatedly raise and lower heels of the feet while the balls and toes of the feet are supported on the pads.

20. A method of exercising and stimulating human feet using the device of claim 6, comprising:

wearing the foot wraps on the feet;

connecting the EMS controller to the foot wraps;

placing the wrapped feet on respective ones of the pads, with the MTP joints positioned in the notches of the respective pads;

repeatedly raising and lowering heels of the feet while the balls and toes of the feet are supported on the pads; and applying EMS impulses generated by the controller to the feet while the feet are raised or lowered.

* * * * *